US006478159B1

(12) United States Patent
Taylor et al.

(10) Patent No.: US 6,478,159 B1
(45) Date of Patent: Nov. 12, 2002

(54) COMBINATION SHIPPING AND DISPLAY CONTAINER AND METHODS THEREFOR

(75) Inventors: Thomas H. Taylor, Guilford; David Dombrowski, Madison; Brian W. Foster, Trumbull, all of CT (US); Peter A. M. Robberecht, Schoten (BE); Ramon Edward Stroink, Mettmann (DE)

(73) Assignee: Warner-Lambert Company, Morris Plains, NJ (US)

( * ) Notice: Subject to any disclaimer, the term of this patent is extended or adjusted under 35 U.S.C. 154(b) by 0 days.

(21) Appl. No.: 09/576,268

(22) Filed: May 22, 2000

(51) Int. Cl.[7] ..... B65D 75/50
(52) U.S. Cl. ..... 206/738; 206/774; 229/235
(58) Field of Search ..... 206/738, 746, 206/736, 774, 779; 229/200, 239, 242

(56) References Cited

U.S. PATENT DOCUMENTS

| | | | | | |
|---|---|---|---|---|---|
| 2,751,964 | A | * | 6/1956 | Guyer | 206/738 |
| 3,090,483 | A | * | 5/1963 | Atltree et al. | 229/235 |
| 3,884,348 | A | * | 5/1975 | Ross | 206/774 |
| 4,058,206 | A | | 11/1977 | Morse et al. | |
| 4,116,330 | A | | 9/1978 | Ellis | |
| 4,946,042 | A | | 8/1990 | Ferreri et al. | |
| 5,167,324 | A | * | 12/1992 | Miller | 206/738 |
| 5,181,650 | A | * | 1/1993 | Hollander et al. | 229/103 |
| 5,413,276 | A | | 5/1995 | Sheffer | |
| 5,505,371 | A | | 4/1996 | O'Neill | |
| 5,651,497 | A | | 7/1997 | Ventura | |
| 5,657,872 | A | | 8/1997 | Leftwich et al. | |
| 5,690,213 | A | * | 11/1997 | Matsumura | 206/738 |
| 5,820,268 | A | * | 10/1998 | Becker et al. | 383/99 |
| 5,826,728 | A | | 10/1998 | Sheffer | |
| 5,881,884 | A | | 3/1999 | Podosek | |
| 5,957,294 | A | * | 9/1999 | Kanter | 206/774 |
| 5,979,749 | A | * | 11/1999 | Rozich | 229/235 |
| 6,073,833 | A | * | 6/2000 | Desrosiers et al. | 229/235 |
| D431,462 | S | * | 10/2000 | Menaged et al. | D9/416 |
| 6,135,289 | A | * | 10/2000 | Miller | 206/774 |
| 6,209,786 | B1 | * | 4/2001 | Yelton et al. | 229/241 |

* cited by examiner

*Primary Examiner*—Shian Luong
(74) *Attorney, Agent, or Firm*—Peter C Richardson; Gregg C Benson; Raymond D Thompson

(57) ABSTRACT

A combination shipping and display container includes a unitary blank of material foldable into a substantially rectangular container for receiving one or more items packed therein. The container has a top wall, a bottom wall, a front wall, a rear wall and first and second side walls. The container has a line of continuous perforations extending across the rear wall, the first side wall, the front wall and the second side wall for dividing the container into a first or tear away top section and a second or bottom section. The perforations in the first and second side walls define curved slopes extending between the rear wall and the front wall. The top section may be torn away from the bottom section along the perforations formed in the container for converting the bottom section into a display container for displaying the one or more items, commonly referred to as primary packages, packed in the container. In one embodiment, after the top section has been removed, the display container in made up of the bottom wall, the rear wall and portions of the front wall and the first and second side walls.

1 Claim, 12 Drawing Sheets

COMBINATION SHIPPING AND DISPLAY CONTAINER AND METHODS THEREFOR

FIELD OF THE INVENTION

The present invention generally relates to containers for packing and shipping goods and more particularly relates to containers that can be converted from shipping containers to display containers for displaying the goods packed therein.

BACKGROUND OF THE INVENTION

Containers are typically provided for packing and shipping goods from a manufacturing location to a point-of-purchase location, such as a retail establishment. Such containers are generally formed from a one-piece blank of corrugated cardboard that is cut, scored and folded to produce a box or container having a substantially rectangular shape. After the rectangular-shaped container has been formed, one or more items are packed in the container. The container is then sealed and shipped to distribution centers and eventually to a final destination, such as a retail outlet. Once the container has reached the retail outlet, the container must be opened, such as by using a razor knife, and the items packed therein are removed from the container and placed upon display shelves.

There are a number of drawbacks associated with using conventional shipping containers. First, a significant amount of labor is required to remove the packed goods from the container and place the goods on display shelves. In addition, opening the containers may require a significant amount of effort and/or additional tools such as a razor knife or box cutter. Moreover, the containers must then be discarded, thereby resulting in a significant waste of material. On the other hand. if the containers are recycled, a significant amount of manpower is required to collect the containers and transport the collected containers to a recycling center.

Thus, there is a need for a combination shipping and display container that can be utilized to ship a plurality goods packed therein to a final location such as on a shelf or a peg hook. The container should be easily convertible into a display container at the point-of-purchase, thereby eliminating at least some of the extensive labor typically required to transfer packaged goods from the container to the display shelves. There is also a need for a combined shipping and display container that can be easily opened without requiring additional tools by providing continuous perforations through one or more walls of the container. Such a container should include a removable first or upper section that may-be torn away from the lower section along the perforations formed through the one or more walls so as to expose the packaged articles for display.

There have been a number of efforts directed to providing shipping containers that may also be used as display container. For example, U.S. Pat. No. 5,881,884 to Podosek discloses a carton that is used to both ship and display a plurality of articles. The carton comprises a single-piece blank cut and scored to include a top panel, a right side panel, a bottom panel and a left side panel foldably connected together to form a box-shaped carton having an open front and an open back. The carton blank also includes four front flaps, one front flap being foldably connected to each of the panels so as to close the open front of the carton when folded. The blank further includes four back flaps, one back flap being foldably connected to each of the panels so as to close the open back of the carton when folded. The left side panel and the front flap connected to the left side panel have a first perforated tear line. Similarly, the right side panel and the front flap connected to the right side panel have a second perforated tear line. The first and second perforated tear lines enable the carton to be severed along the tear lines to convert the carton to a display container for displaying a plurality of articles packed therein.

U.S. Pat. No. 5,505,371 to O'Neill discloses a shipping and display carton including an outer container and inner partition. The partition is constructed from a single cut and scored blank of corrugated paper board that is folded and erected to form a modified Z-type divider with three loading cells. The front wall of the outer container includes a perforated cutout that is removed for display purposes. Each divider panel of the partition includes a cutout that is compatible in size and shape with the cutout in the front wall of the outer container.

U.S. Pat. No. 5,826,728 to Sheffer discloses a shipping and display container that is formed from an integral piece of corrugated paper board. The container has a top that includes two opposing flaps allowing access to the interior space of the container for loading items therein. The two flaps are adhered to each other at their opposing edges when the container is closed and sealed for shipping. The items may be removed from the container by separating the top from the side walls at perforation lines extending generally at the outer edges of the top. The front of the container has removable portions that are integrally attached to the top so that a pair of windows is formed when the container is opened. The goods are accessible through the two windows as well as through the top of the open container.

U.S. Pat. No. 4,946,042 to Ferreri et al. discloses a readily openable combination shipping and display carton. The carton is formed from a carton blank having a plurality of tearable lines of weakness such as perforations and/or dividing lines for defining a removable section. As least one removable panel or section is provided and may be removed by tearing along such lines of weakness. An opening for hand access to remove the removable section is also provided.

U.S. Pat. No. 4,058,206 to Morse et al. discloses a display carton comprising a one-piece blank that is cut and scored to form vertically disposed front, back and side panels and horizontally disposed top and bottom panels. A vertically extending partition is provided between the side panels and is attached to the front, back and bottom panels by lock tabs engaging slots formed through the panels. A continuous tear line is formed in the front, back, side, and top panels to divide the carton into a removable upper section and a lower section for retaining a plurality of upstanding packages therein for display purposes.

SUMMARY OF THE INVENTION

In one preferred embodiment of the present invention, a combination shipping and display container includes a unitary blank of material foldable into a substantially rectangular container for receiving one or more items packed therein.

The container preferably has a top wall, a bottom wall, a front wall, a rear wall, a first side wall and a second side wall. The container is desirably made of a corrugated cardboard material such as a B-flute corrugated cardboard material. One side of the corrugated cardboard is preferably laminated with a solid bleach sulfate paper that may form the outer surface of the container for receiving printed indicia thereon. The container also preferably has a line of continuous perforations extending across the rear wall. the first side wall, the front wall and the second side wall for dividing the container into a first or tear away top section and a second or bottom section. The perforations in the first and second side walls define respective curved slopes that extend between the rear wall and the front wall of the container. The top section of the container is removable from the bottom section of the container along the perforations for converting the bottom section into a display container for displaying the one or more items packed therein.

The perforations typically extend at least partially through the rear, front and two side walls of the container. The perforations formed :in the first and second side walls desirably extend from upper ends of the side walls toward the botton wall of the container. The perforations in the front wall are desirably proximate the bottom wall of the container and extend in a direction that is substantially parallel to the bottom wall of the container. The perforations in the rear wall are desirably proximate the top wall of the container. At least a section of the perforations in the rear wall may define a tab that is hingedly connected to the top wall of the container. The tab may be depressed for cracking the perforations in the rear wall that define the shape of the tab and to separate the tab from the rear wall.

The present invention further includes a method of converting a shipping container into a display container including providing a shipping container with one or more items packed therein having a top wall, a bottom wall, a front wall, a rear wall and first and second side walls extending between the front and rear walls, whereby the container has a line of continuous perforations extending across the rear wall, the first side wall, the front wall and the second side wall for dividing the container into a first or tear away top section and a second or bottom section. The perforations in the first and second side walls preferably define curved slopes that are substantially similar in appearance and that extend between the rear wall and the front wall. At least some of the perforations between the first and second sections of the container are then cracked and the first or top section of the container is torn away and/or removed from the second section of the container along the perforations for simultaneously opening the shipping container and displaying the one or more items packed in the second section.

DETAILED DESCRIPTION OF PREFERRED EMBODIMENTS

Figure 1:
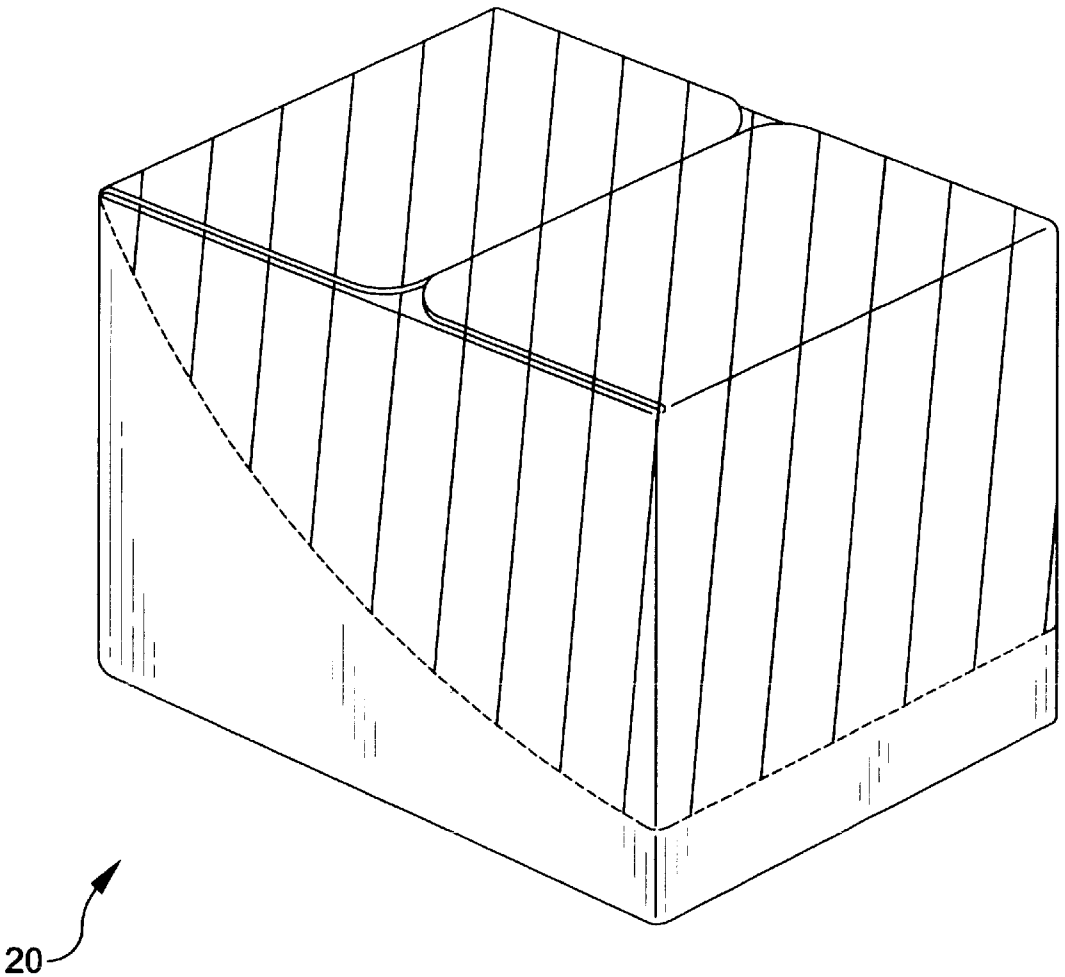
FIG. 1 shows a combination shipping and display container having a first upper section and a second bottom section and a line of continuous perforations dividing the first and second sections of the container, in accordance with certain preferred embodiments of the present invention.

FIG. 1 shows a combination shipping and display container 20, in accordance with certain preferred embodiments of the present invention. As will be described in more detail below, the container includes a first or tear away top section that may be removed from a second or bottom section along a line of continuous perforations.

Referring to FIG. 2, the combination shipping and display container includes a unitary blank 22 of a material such as corrugated cardboard. The unitary blank includes a number of fold lines extending between various walls and/or flaps of the container. The unitary blank 22 has a rear wall 24 having an upper end 26, a lower end 28, a first lateral edge 30 and a second lateral edge 32. The upper end 26 of the rear wall 24 is hingedly connected to an upper flap 34 along a fold line 36 that defines a boundary between the upper end 26 of the rear wall 24 and the upper flap 34. The rear wall 24 includes perforations 38 that extend at least partially across the upper end 26 of the rear wall 24 at the fold line 36. The rear wall 24 also includes a second set of perforations 38' that define a tab 40 permanently attached to upper flap 34 at an intermediate portion 36' of the fold line 36. The rear wall 24 also includes a lower flap 42 hingedly connected to the lower end 28 of rear wall 24 at fold line 44.

The unitary blank 22 also has a first side wall 46 having an upper end 48, a lower end 50, a first lateral edge 52 and a second lateral edge 54. The upper end 48 of the first side wall 46 is hingedly connected to upper flap 56 via fold line 58 and the lower end 50 of the first side wall 46 is hingedly connected to lower flap 60 at fold line 62. The second lateral edge 32 of the rear wall 24 is hingedly connected to the first lateral edge 52 of first side wall 46 at fold line 64 extending therebetween.

The cardboard blank 22 also includes a front wall 66 having an upper end 68, a lower end 70, a first lateral edge 72 and a second lateral edge 74. The front wall 66 has an upper flap 76 hingedly connected to an upper end 68 at fold line 78 and a lower flap 80 hingedly connected to the lower end 70 thereof at fold line 82. The first lateral edge 72 of the front wall 66 is hingedly connected to the second lateral edge 54 of the first side wall 46 at fold line 84.

The unitary blank 22 also includes a second side wall 86 having an upper end 88, a lower end 90, a first lateral edge 92 and a second lateral edge 94. The second side wall 86 includes an upper flap 96 hingedly connected to the upper end 88 thereof at fold line 98 and a lower flap 100 hingedly connected to the lower end 90 thereof at fold line 102. The first lateral edge 92 of the second side wall 86 is hingedly connected to the second lateral edge 74 of front wall 66 at fold line 104. The second side wall 86 also includes an attachment flange 106 extending from the second lateral edge 94 thereof so that the second lateral edge 94 of the second side wall 86 may be secured adjacent the first lateral edge 30 of rear wall 24 when the unitary blank 22 is folded into a substantially rectangular container. An adhesive such as glue may be applied to the attachment flange 106 and the attachment flange adhered to the interior surface of rear wall 30 adjacent the first lateral edge 30 thereof.

The unitary blank 22 has a line of continuous perforations 108 extending across the first side wall 46, the front wall 66 and the second side wall 86. The continuous perforations 108 include in series a first section 108A extending across the first side wall 46, a second section 108B extending across the front wall 66 and a third section 108C extending across the second side wall 86. The first section of perforations 108A has a first end 110 that commences at the intersection of fold line 64 and fold line 58. The first section of perforations 108A then slopes downwardly along an arc or curved path toward the lower end 50 of the first side wall 46. The first section of perforations 108A continues to the second edge 54 of the first side wall 46 and terminates at second end 112.

The second section of perforations 108B then commence at the first lateral edge 72 and extends completely across the front wall 66 to the second lateral edge 74 thereof. The second section of perforations 108B preferably extends in a direction that is substantially parallel to the lower end 70 of the front wall 66. The third section of perforations 1 08C extends from the first lateral edge 92 to the second lateral edge 94 of the second side wall 86. The third section of perforations 108C has a first end 114 that commences at the terminus of the second section of perforations 108B and a second end 116 that extends to the intersection of the upper end 88 and the second lateral edge 94 of the second side wall 86. As mentioned above, the first section of perforations 108A and the third section of perforations 108C define curved or arched slopes that are substantially mirror images of one another. Thus, the perforations 108 extend in a continuous and uninterrupted pattern completely across the first side wall 46, the front wall 66 and the second side wall 86.

Figure 2A:
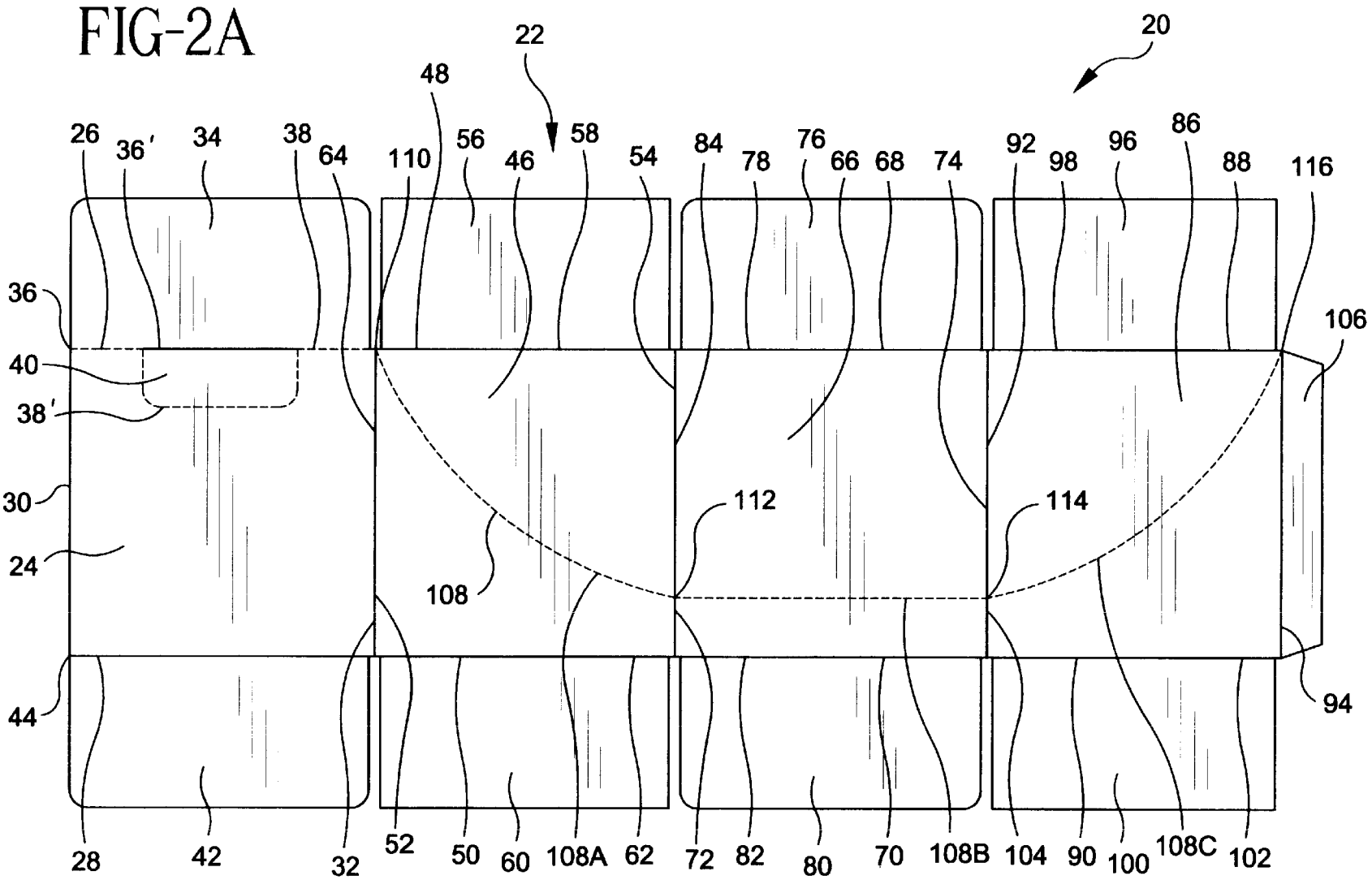
FIG. 2A shows a top view of a unitary blank used for assembling the container shown in FIG. 1.
Figure 2B:
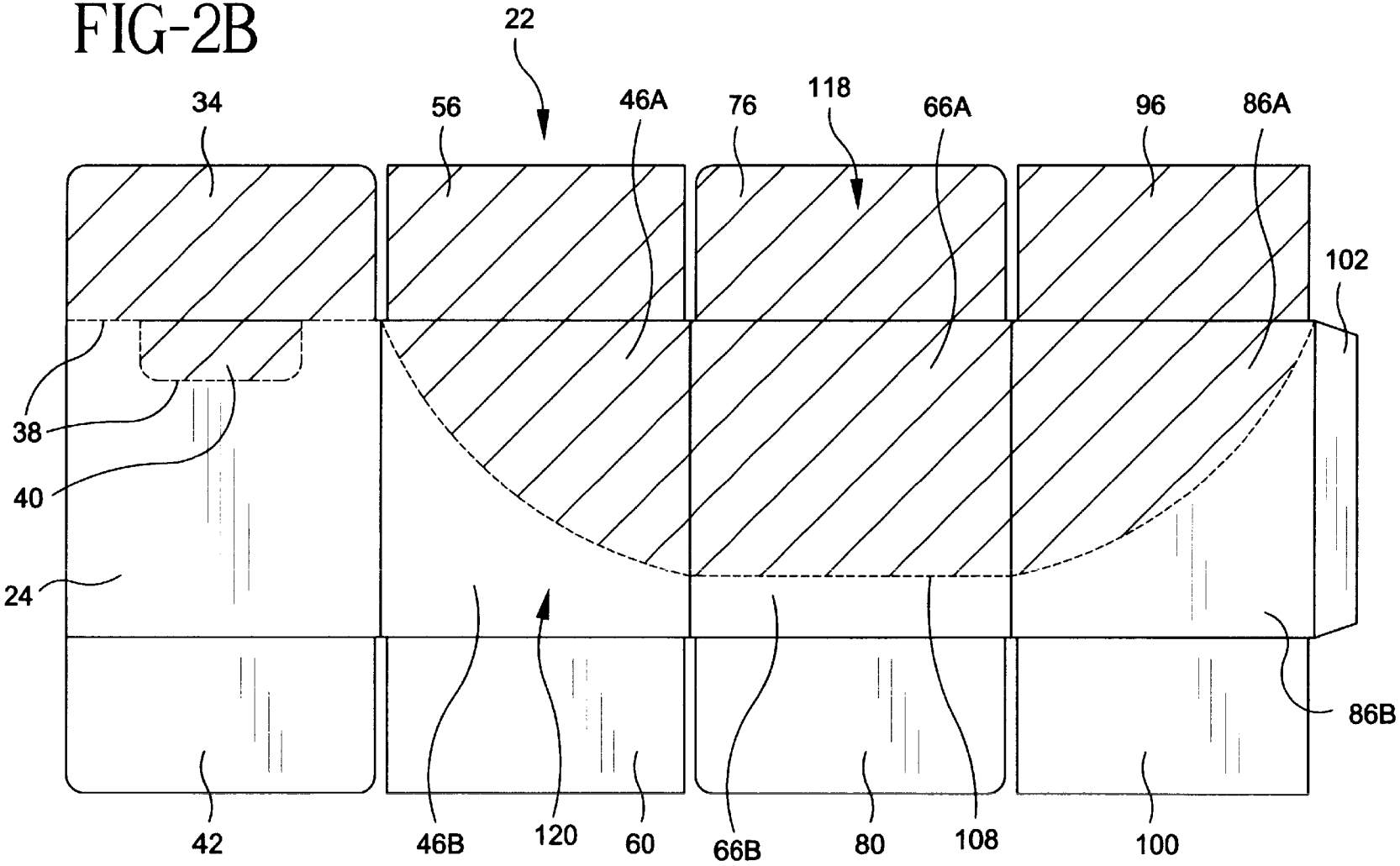
FIG. 2B shows a top view of the blank of FIG. 2A including the first and second sections divided by the line of continuous perforations.

Referring to FIG. 2B, the perforations 38 and 108 are continuous and uninterrupted so as to divide the unitary blank 22 into a first or tear away top section 118 and a second or bottom section 120. The top section 118 includes upper flaps 34, 56, 76 and 96, the tab 40 connected to upper flap 34, upper sections 46A and 86A of first and second side walls 46 and 86, and upper section 66A of front wall 66. The bottom section 120 includes lower flaps 42, 60, 80 and 100, rear wall 24, lower sections 46B and 86B of first and second side walls 46 and 86, and the lower section 66B of front wall 66. After the container 20 has been fully assembled and one or more items have been sealed therein, the top section 118 may be removed and/or torn away from the bottom section 120 along the continuous perforations 38 and 108 to leave behind the bottom section 120 which forms a display container for the one or more items packed therein.

Figure 3:
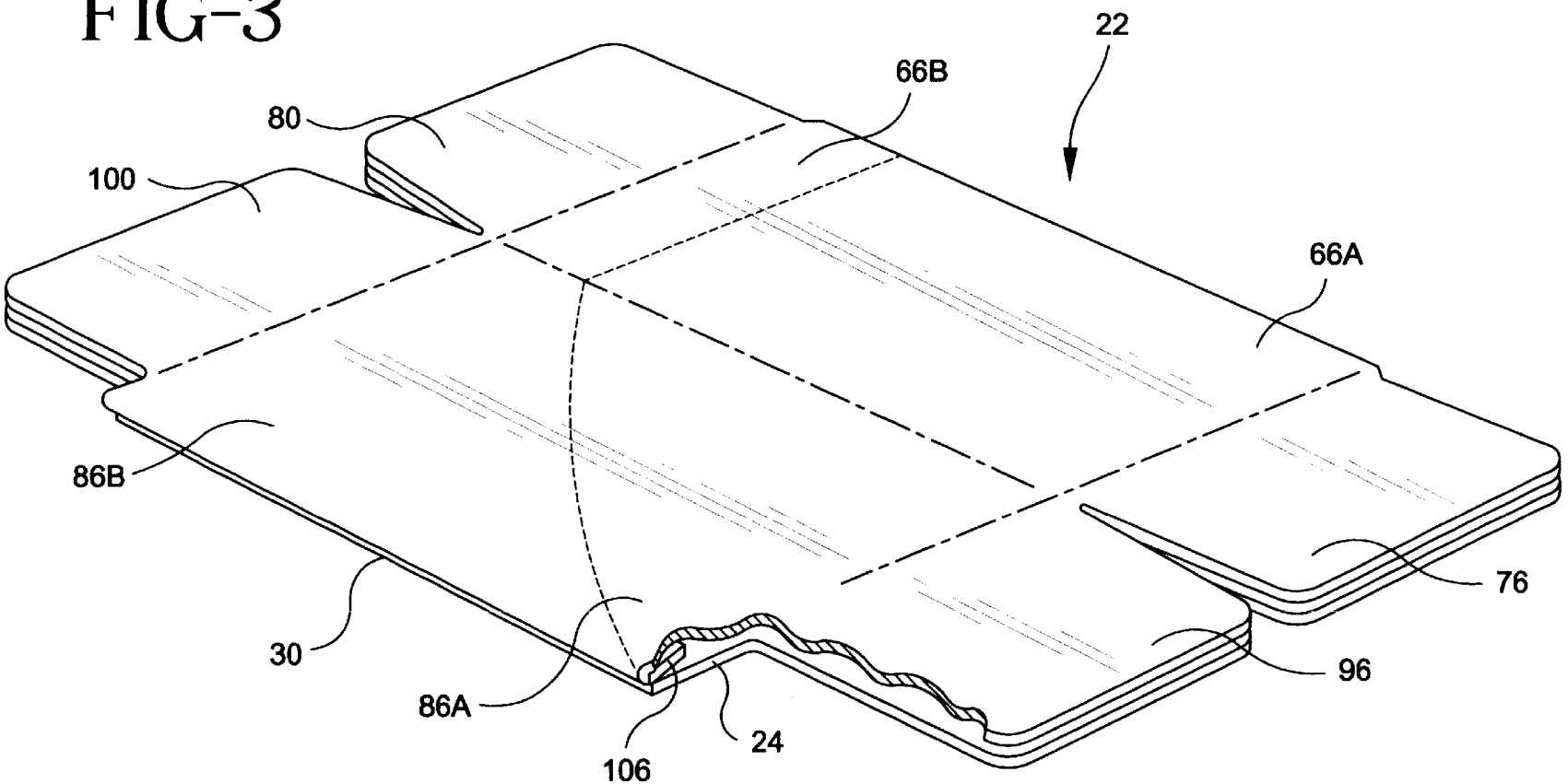
FIG. 3 shows a perspective view of the unitary blank shown in FIGS. 2A and 2B after partial assembly of the blank, and also shows a cut-away view of a portion of the blank.

FIG. 3 shows the unitary blank 22 of FIG. 2A in a partially assembled configuration. A cutaway portion of FIG. 3 shows an attachment flange 106 adhered to the first lateral edge 30 of rear wall 24. Before the blank 22 is formed into a substantially rectangular container, the blank is preferably stored in the substantially flat condition shown if FIG. 3 so as to occupy as little space as possible. The unitary blank is preferably made of B-flute corrugated cardboard. The outer surface of the corrugated cardboard is preferably a mottled white surface. The mottled white surface is used to print product information, packaging and/or shipping data onto the outer surface of the container. The B-flute corrugated cardboard and the mottled white surface is preferably die cut with a steel rule die to shape the unitary blank 22 and form the perforations therein. In other preferred embodiments, the outer surface of the corrugated cardboard may be laminated with a solid bleach sulfate paper such as a white solid bleach sulfate paper.

Figure 4:
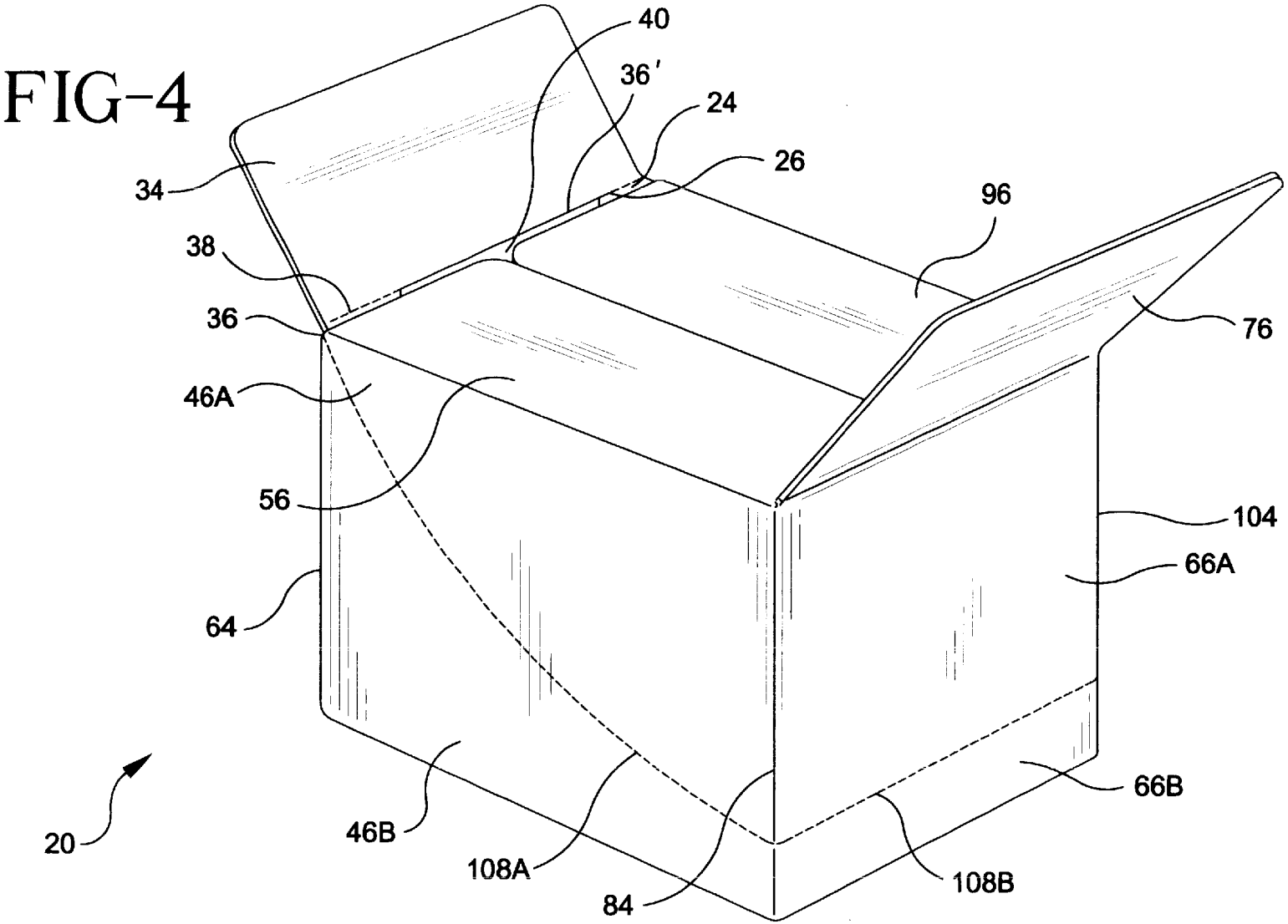
FIG. 4 shows the container blank of FIG. 3 during a further stage of a container assembly process.

FIG. 4 shows the unitary blank 22 of FIG. 3 during a further stage of forming a substantially rectangular container. During assembly of the container, the rear wall (not shown), the first side wall 46, the front wall 66 and the second side wall (not shown) are folded into a substantially square-shaped configuration and an adhesive is provided on attachment flange 106 (FIG. 2) so that the second lateral edge 94 of the second side wall 86 may be attached to rear wall 24 adjacent first lateral edge 30. The lower flaps 60 and 100 of first and second side walls 46 and 86 are folded inwardly toward one another and the lower flaps 42 and 80 of the front and rear walls 24 and 66 are folded atop the flaps 60 and 100. The lower flaps 42, 60, 80 and 100 are preferably secured together using an adhesive so as to form the bottom wall of the container 20. One or more items may then be packaged and/or placed within the container 20. In order to seal the container, the upper flaps 56 and 96 of the respective first and second side walls 46 and 86 are folded toward one another and upper flaps 34 and 76 extending from respective rear and front walls 24 and 66 are folded atop upper flaps 56 and 96. An adhesive may also be applied upon one or more of the upper flaps when sealing the container 20. The upper flap 34 is releasably connected to the upper end 26 of rear wall 24 via perforations 38 extending along fold line 36. The upper flap 34 includes a tab 40 permanently connected thereto at fold line 36'. The container 20 includes a first section of perforations 108A and the front wall 66 includes a second section of perforations 108B. A third section of perforations 108C (not shown) substantially mirrors the first section of perforations 108A.

Figure 5:
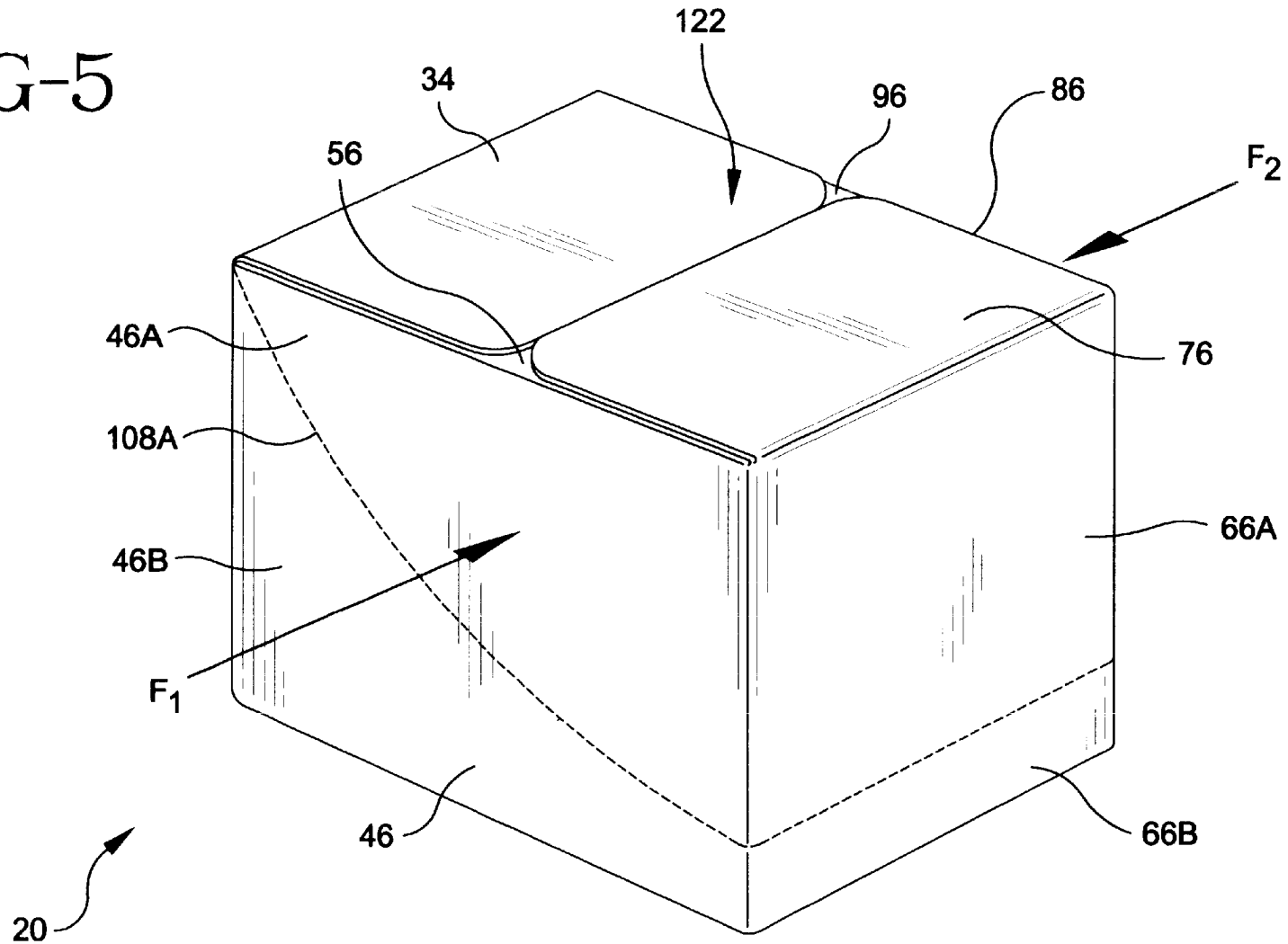
FIG. 5 shows a perspective side view of the container of FIG. 1 during a first stage of opening the container and removing the first section of the container from the second section of the container.
Figure 6:
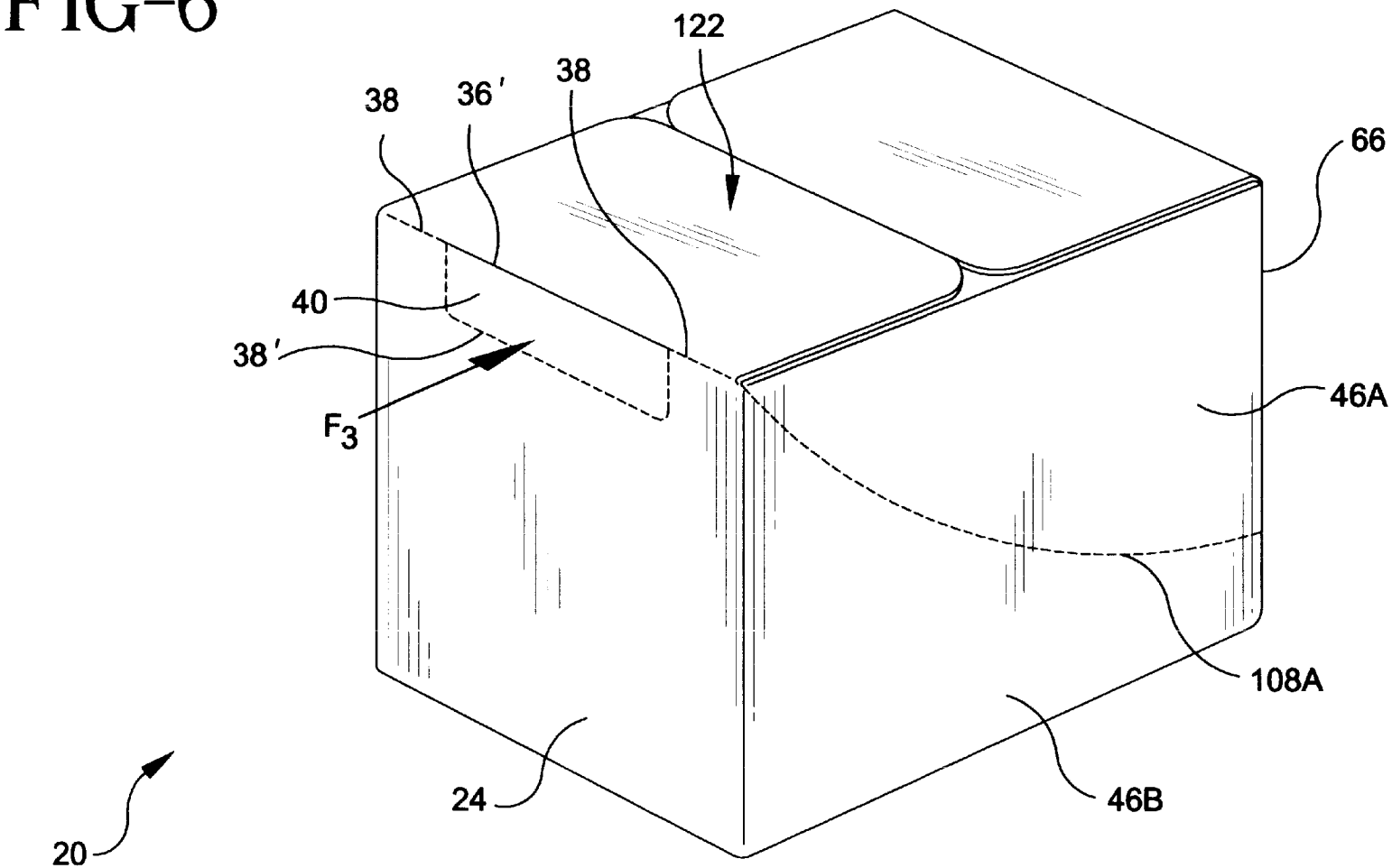
FIG. 6 shows a perspective rear view of the container of FIG. 5 during a second stage of opening the container and removing the first section of the container from the second section of the container.

FIG. 5 shows the combined shipping and display container in the fully assembled configuration with one or more items preferably sealed within the container 20. The four upper flaps 56, 96, 34 and 76 are adhered together and form the top wall 122 of the container 20. The combination shipping and display container may then be shipped from an assembly and packing plant to a final destination such as a distribution center and then onto a retail establishment having a display shelf or a peg hook. Once the container 20 has reached its final destination, the container may be opened so as to display the one or more items packed therein. In a first step, opposing lateral forces $F_1$ and $F_2$ are applied in the generally vicinity of the perforations on the opposing first and second side walls 46 and 86. The forces $F_1$ and $F_2$ are preferably applied either directly on the perforated sections 108A and 108C; above the perforated sections 108A and 108C, i.e. to the upper section 46A of the first side wall 46 and the upper section 86A of the second side wall 86; or below the perforated sections 108A and 108C, i.e., to the lower section 46B of the first side wall 46 and the lower section 86B of the second side wall 86 . The opposing lateral forces $F_1$ and $F_2$ are designed to crack and/or break the perforations in the opposing side walls 46 and 86. Referring to FIG. 6, a force $F_3$ is then exerted upon the tab 40 hingedly connected to the top wall 122 at fold line 36'. The force $F_3$ is preferably directed toward the front wall 66 of the container 20. The force $F_3$ cracks the perforations 38' surrounding the tab 40 so as to provide a grippable opening. The grippable opening may then be secured by a user's hand and the grippable opening and the top wall 122 pulled toward the front wall 66 of the container 20. As the front wall is pulled away from the rear wall 24, the perforations 38 on either side of tab 40 are cracked and/or torn, thereby freeing the top wall 122 from its detachable connection with the rear wall 24.

Figure 7A:
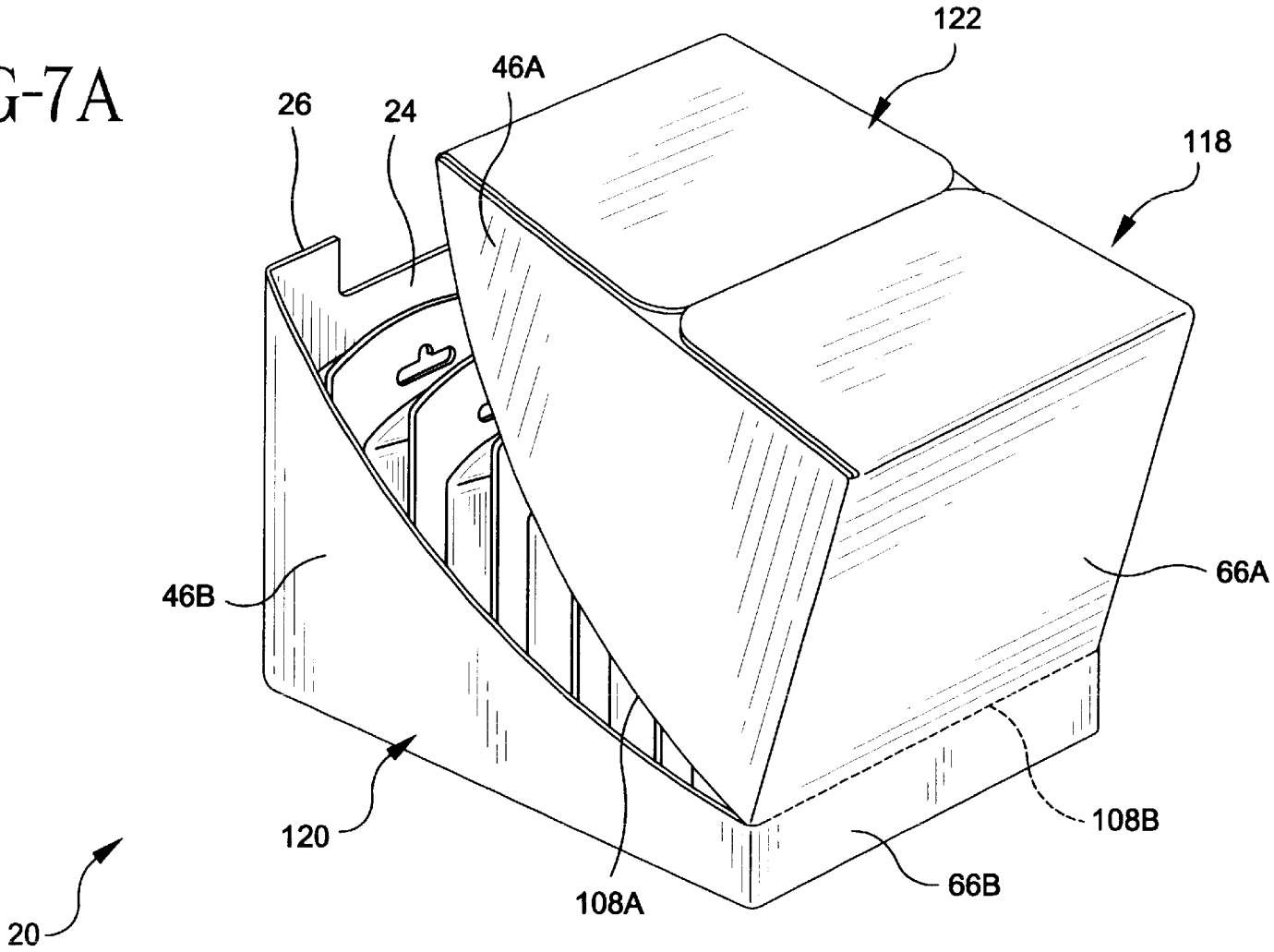
FIG. 7A shows a perspective side view of the container of FIGS. 5 and 6 during a third stage of opening the container and removing the first section of the container from the second section of the container.
Figure 7B:
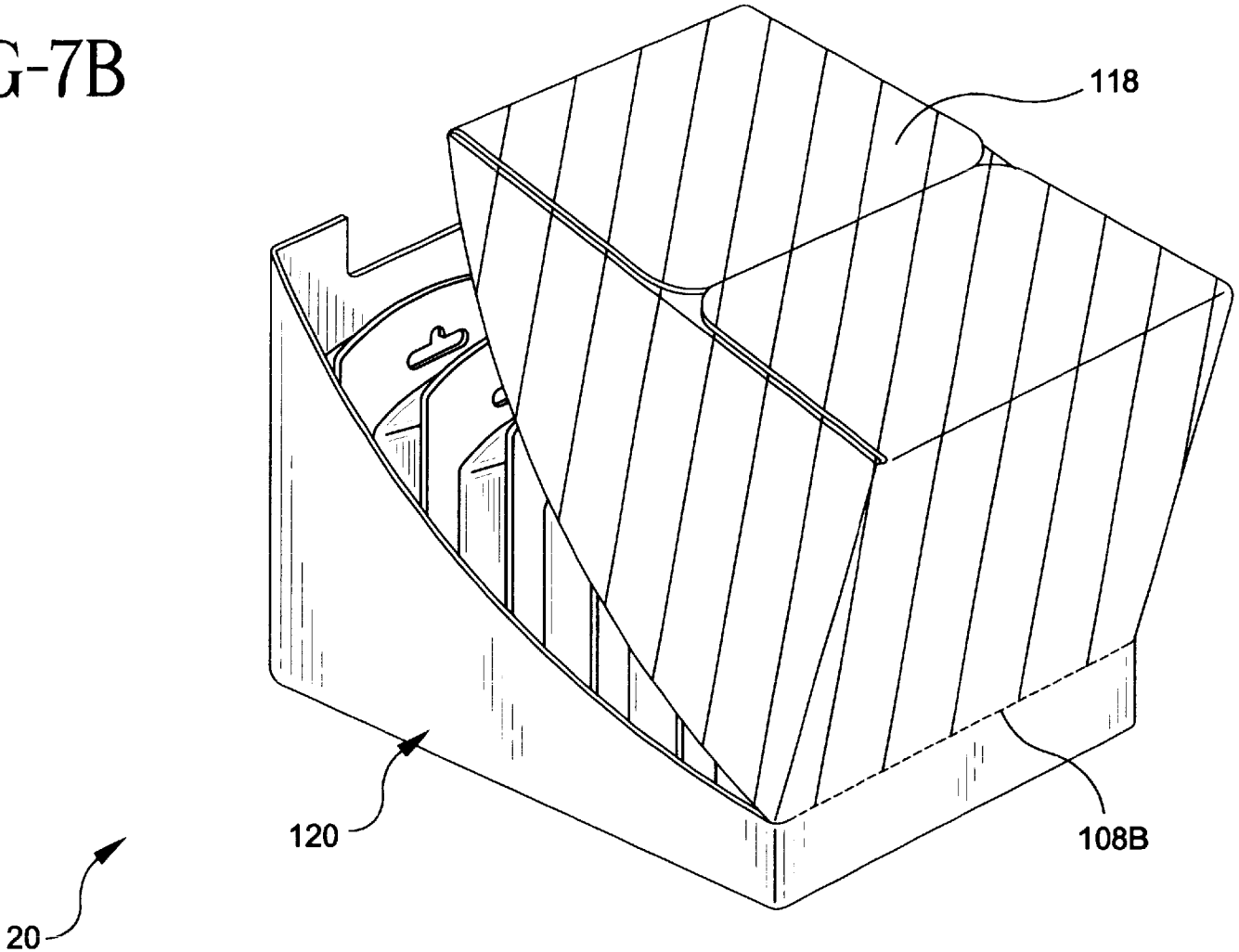
FIG. 7B shows a simplified view of the container of FIG. 7A including the first removable section and the second section.

Referring to FIGS. 7A and 7B, the first section of the container 118 is then completely detached from the bottom section 120 of the container by tearing the upper section 66A of the front wall 66 away from the lower section 66B thereof along perforations 108B. The curved slope of the perforations in the first and second side walls 46 and 86 (FIG. 2A) enables the first section to be removed in one motion. This is a dramatic improvement over prior art containers whereby the perforated line changes direction one or more times, thereby increasing the time required to open a container. In addition, the prior art containers are also prone to rip or fray at the point where the perforations change direction.

Figure 8:
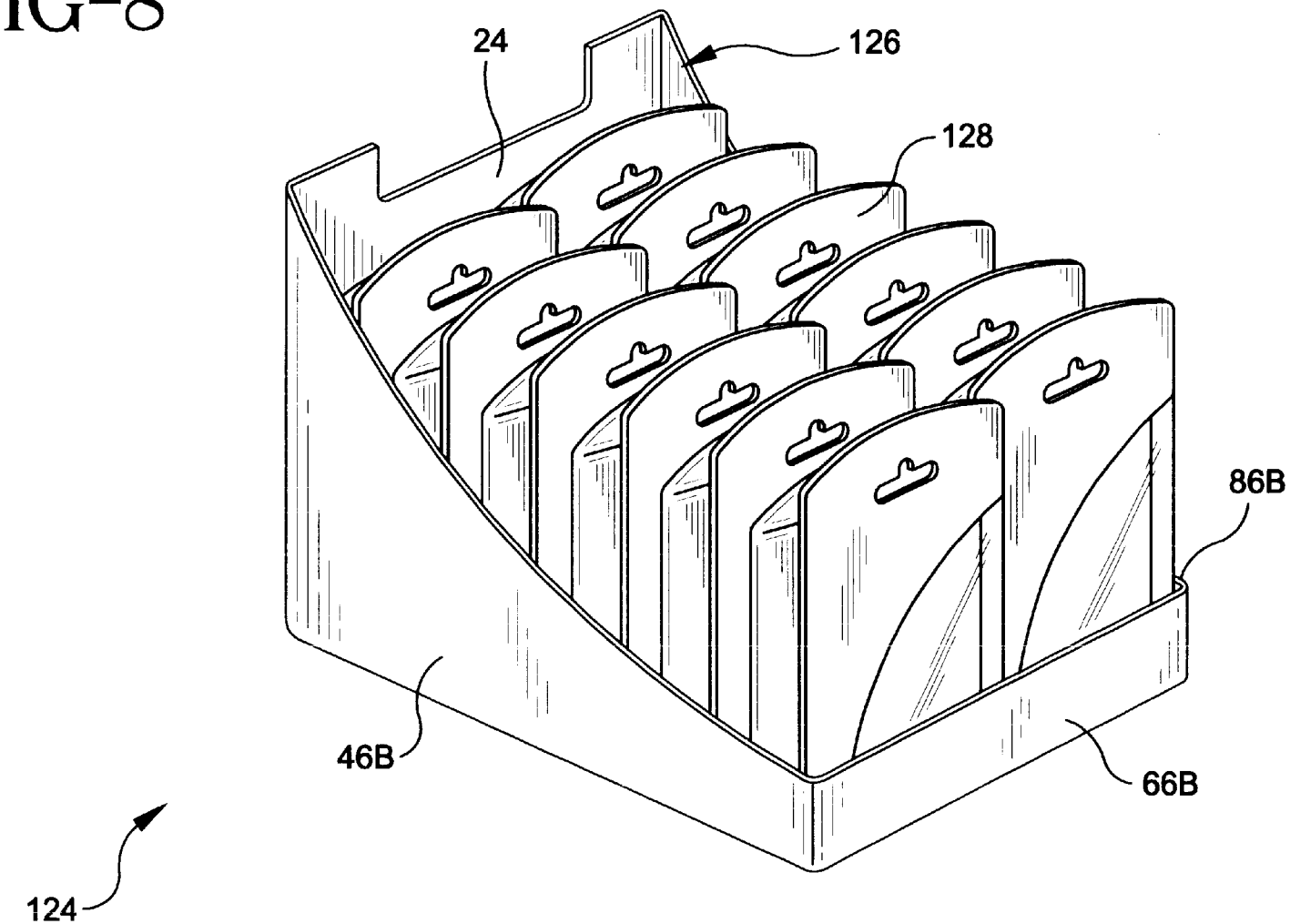
FIG. 8 shows a perspective view of the container of FIGS. 5–7B after the first section has been completely removed to provide a display container for displaying primary packages stored therein.

FIG. 8 shows the container of FIG. 5 after the first section thereof has been completely removed so as to convert the container into a display container 124. The display container 124 preferably includes the rear wall 24, the lower section 46B of the first side wall 46, the lower section 66B of the front wall 66 and the lower section 86B of the second side wall 86. The interior section 126 of the display container 124 is preferably adapted for receiving one or more primary packages 128 therein, such as packages for razor assemblies.

Figure 9:
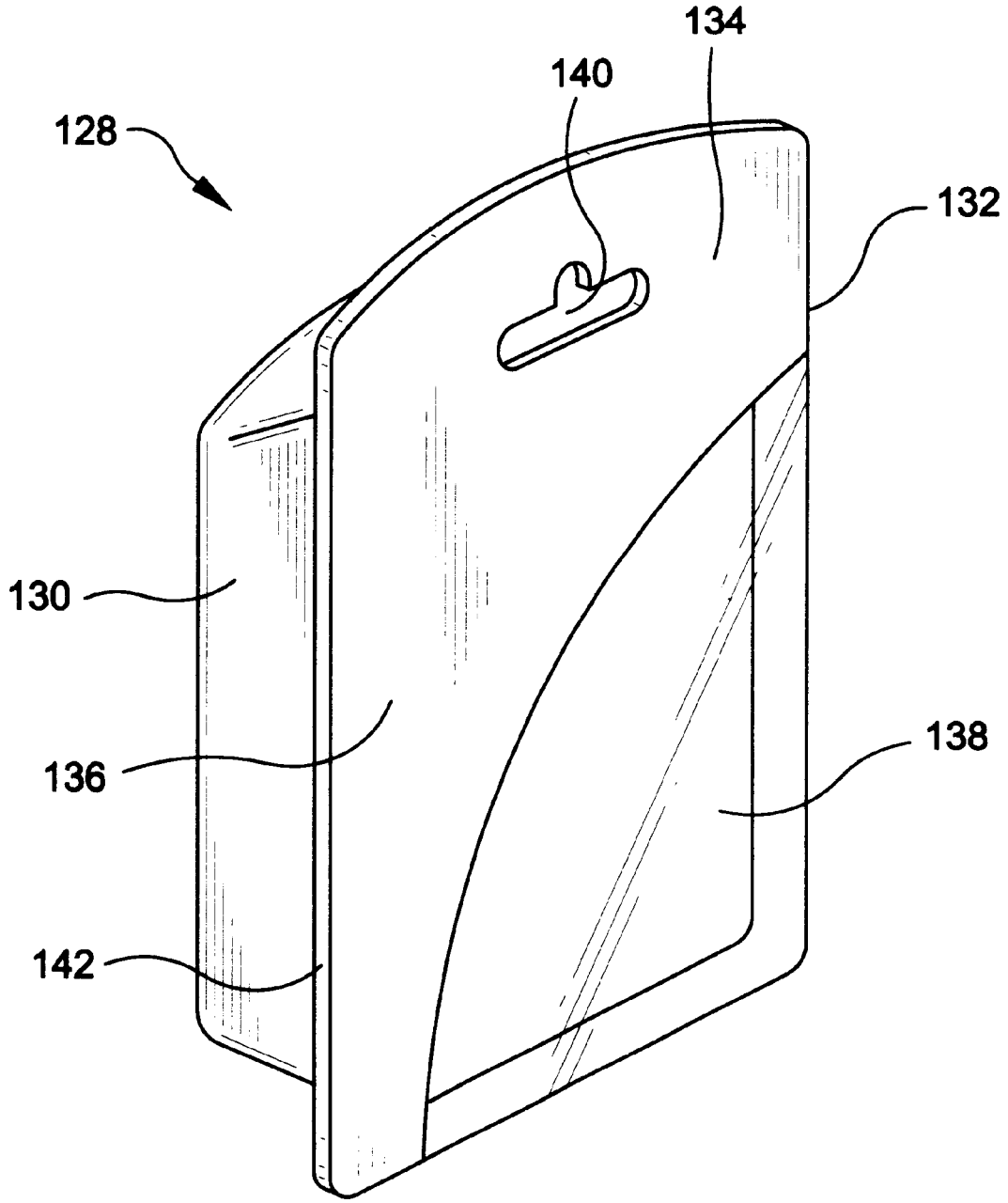
FIG. 9 shows a perspective view of one of the primary packages shown in FIG. 8.

FIG. 9 shows a primary package 128 in accordance with certain preferred embodiments of the present invention. The primary package 128 includes a bucket or tub section 130 preferably made of a clear polymer material such as plastic. The primary package 128 also has a film or lid overlying the tub 130 for sealing one or more items therein, such as a razor assembly. The plastic lid 132 preferably has an opaque region 134 for receiving printed indicia and/or designs, a tinted, partially transparent region 136 below the opaque region 134 and a clear or transparent region 138 below the tinted region 136. The transparent region 138 allows a consumer to see the one or more items sealed within the tub 130 of the primary package 128. The lid 132 includes an outer flange 142 that extends beyond the outer perimeter of the tub 130. The primary package 128 also includes a slot, commonly referred to as a global hang-hole or hanger slot 140, so that the primary package 128 may be placed on a display hook or rack, if desired.

Figure 10:
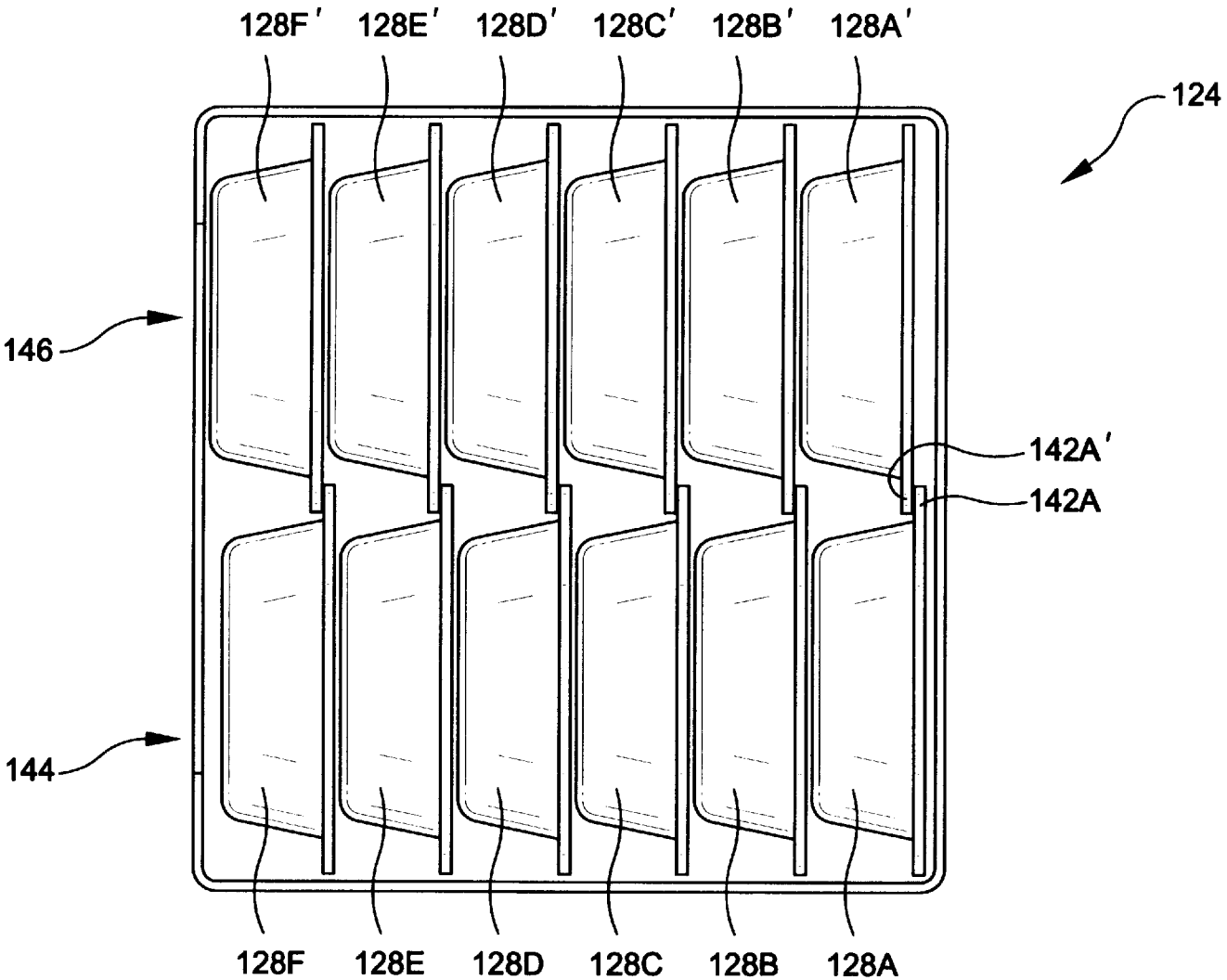
FIG. 10 shows a top view of the display container of FIG. 8 with a plurality of the primary packages of FIG. 9 stored therein.

FIG. 10 shows a top view of the display container 124 shown in FIG. 8 with a plurality of primary packages 128 stored therein. In this particular embodiment, two rows of primary packages 128 are stored within the display container 124. A first row 144 includes primary packages 128A–128F. A second row 146 includes primary packages 128A'–128F'. The respective primary packages 128 are packed within the display container 124 so that the opposing flanges overlap one another. For example, the flange 142A of primary package 128A overlaps the flange 142A' of primary package 128A'. By overlapping the opposing flanges, the primary packages take up less volume within the container 124. As a result, a greater number of primary packages 128 may be stored within a container and less material may be required for shipping and displaying the primary packages. The overlapping flanges 142 also provide lateral support for the primary packages packed next to one another. This lateral support prevents the primary packages from moving about and/or shifting during shipping. Overlapping the flanges 142 also protects the outer edges of the flanges from becoming chipped, dented an/or cracked during shipment, as commonly occurs with containers that allow the opposing flanges of adjacent items to contact one another.

Although the invention herein has been described with reference to particular embodiments, it should be understood that these embodiments are merely illustrative of the principles and applications of the present invention. Thus, numerous modifications may be made to the illustrative embodiments and other arrangements may be devised without departing from the spirit and scope of the present invention as defined by the appended claims.

What is claimed is:

1. A combination shipping and display container comprising:

a unitary blank of material foldable into a substantially rectangular container for receiving one or more items packed therein, said container having a top wall, a bottom wall, a rear wall, a first side wall and a second side wall; and a line of continuous perforations extending across the rear wall, the first side wall, the front wall and the second side wall for dividing said container into a first section and a second section, the perforations in the first and second side walls defining curved slopes extending between the rear wall and the front wall of said container, the perforations in the front wall being proximate to the bottom wall of the container and the perforations in the rear wall being proximate to the top wall of the container, at least a section of the perforations in the rear wall defining a tab hingedly connected to the top wall of the container, and the first section being removable from the second section along the perforations for converting the second section into a display container for displaying the one or more items packed therein.

* * * * *